US008677814B2

(12) United States Patent
Evrard

(10) Patent No.: US 8,677,814 B2
(45) Date of Patent: Mar. 25, 2014

(54) DEVICE FOR EXTRACTING AT LEAST ONE TYPE OF GAS CONTAINED IN A DRILLING MUD, AN ANALYSIS ARRANGEMENT AND A RELATED EXTRACTION METHOD

(75) Inventor: Jean-François Evrard, Le Petit Chêne (FR)

(73) Assignee: Geoservices Equipements, Le Blanc Mesnil (FR)

( * ) Notice: Subject to any disclaimer, the term of this patent is extended or adjusted under 35 U.S.C. 154(b) by 1213 days.

(21) Appl. No.: 11/919,215

(22) PCT Filed: Apr. 24, 2006

(86) PCT No.: PCT/FR2006/000914

§ 371 (c)(1),
(2), (4) Date: Jan. 12, 2011

(87) PCT Pub. No.: WO2006/114512

PCT Pub. Date: Nov. 2, 2006

(65) Prior Publication Data

US 2011/0094736 A1 Apr. 28, 2011

(30) Foreign Application Priority Data

Apr. 27, 2005 (FR) ..... 05 04249

(51) Int. Cl.
*E21B 47/00* (2012.01)

(52) U.S. Cl.
USPC ..... 73/152.04; 73/152.18; 73/152.19; 166/267; 166/75.12; 175/217

(58) Field of Classification Search
USPC ..... 73/19.01, 19.09, 23.38, 863.12, 73/152.01–152.62; 166/267, 75.12, 57, 166/302; 96/174; 175/17, 217; 702/9, 6, 24, 702/25

See application file for complete search history.

(56) References Cited

U.S. PATENT DOCUMENTS 4,635,735 A * 1/1987 Crownover ..... 175/48
4,887,464 A * 12/1989 Tannenbaum et al. ..... 73/152.04
5,531,096 A * 7/1996 Castor ..... 73/23.2

(Continued)

FOREIGN PATENT DOCUMENTS

FR 2 799 790 4/2001

OTHER PUBLICATIONS

International Search Report issued Jul. 31, 2006 in the International (PCT) Application of which the present application is the U.S. National Stage.

*Primary Examiner* — Hezron E Williams
*Assistant Examiner* — Hoang Nguyen
(74) *Attorney, Agent, or Firm* — Wenderoth, Lind & Ponack, L.L.P.

(57) ABSTRACT

A device (53) comprises an enclosure (63) and means (65, 67) for circulating a drilling mud in the enclosure (63). The inventive device is also provided with means (69) for introducing a gas carrier into the enclosure (63), which comprises a pipe (113) provided with a unit (121) for adjusting the gas carrier flowrate. The device (53) comprises a gas extracting pipe (71) open into the enclosure (63). The gas introducing means (69) comprise a sensor (123) for measuring a pressure at a point located downstream of the adjusting unit (121) and means (117) for controlling the flowrate of the gas carrier injected through said adjusting unit (121) according to the difference between a pressure measured by the sensor (123) and a determined gas extraction pressure.

14 Claims, 4 Drawing Sheets

(56) References Cited

U.S. PATENT DOCUMENTS

| | | | | |
|---|---|---|---|---|
| 6,443,001 | B1 | 9/2002 | Duriez et al. | |
| 6,755,261 | B2 * | 6/2004 | Koederitz | 175/25 |
| 7,174,254 | B2 * | 2/2007 | Ellis | 702/9 |
| 7,392,138 | B2 * | 6/2008 | Frechin et al. | 702/9 |
| 7,636,614 | B2 * | 12/2009 | Dykstra | 700/282 |
| 7,748,266 | B2 * | 7/2010 | Evrard et al. | 73/152.23 |
| 2006/0075801 | A1 * | 4/2006 | Evrard et al. | 73/19.09 |
| 2009/0008560 | A1 * | 1/2009 | Gunn et al. | 250/343 |

* cited by examiner

DEVICE FOR EXTRACTING AT LEAST ONE TYPE OF GAS CONTAINED IN A DRILLING MUD, AN ANALYSIS ARRANGEMENT AND A RELATED EXTRACTION METHOD

The present invention concerns a device for extracting at least one gas contained in drilling mud of the type comprising:

- an enclosure;
- means for conveying the drilling mud into the enclosure;
- means for removing the drilling mud from the enclosure;
- means for admitting a carrier gas into the enclosure comprising a carrier gas admission pipe, connecting a source of carrier gas to the enclosure, the admission pipe being equipped with a regulating device for regulating the flow of carrier gas circulating in the pipe; and
- a gas extraction pipe opening into the enclosure via a gas extraction opening.

When drilling a well for oil or another effluent (specifically gas, steam, water), a known method is to conduct an analysis of the gaseous compounds contained in the drilling mud emerging from the well. This analysis makes it possible to recreate the geological sequence of formations passed through during drilling and plays a part in determining options for exploiting the deposits of fluids encountered.

This analysis, which is performed continuously, comprises two main phases. The first phase entails extracting the gases carried by the mud (e.g. hydrocarbon compounds, carbon dioxide, hydrogen sulphide, helium and nitrogen). The second phase entails qualifying and quantifying the extracted gases.

In the first phase, degassers with mechanical agitation systems of the aforementioned type (FR-A-2 799 790) are frequently used. The gases extracted from the mud and mixed with the carrier gas admitted to the enclosure are conveyed by suction via the gas extraction pipe to an analysis device which quantifies the extracted gases.

In order to regulate the transfer time for the gases extracted via the extraction pipe, the degasser of the aforementioned type comprises means for admitting a carrier gas into the enclosure. The flow of carrier gas is regulated to a specified value in order to obtain an acceptable transit time in the extraction pipe.

However, the gaseous content of drilling mud varies during drilling. This content increases, especially when the drilling equipment reaches an area which is rich in hydrocarbons. On the other hand, this gaseous content is considerably less rich outside these areas.

In the light of admission of a specified flow of carrier gas into the enclosure, the rate at which gases are extracted from the mud into the enclosure is affected by the presence of the carrier gas, especially when the mud contains a considerable quantity of gas. Furthermore, the transit time in the extraction pipe varies during the analysis, which may affect quality.

Similarly, when the quantity of gas contained in the mud is small or non-existent, the flow of gases extracted via the extraction pipe is not entirely offset by the flow of carrier gas admitted, which may cause mud to be sucked through the extraction pipe and the device to become blocked.

The principal object of the invention is to provide an extraction device of the aforementioned type, with constant reliability and precision irrespective of the gaseous content of the drilling mud.

To this end, the invention relates to a device of the aforementioned type, characterised in that the means for admitting the carrier gas comprise:

- a sensor for measuring the instantaneous pressure at a point located downstream of the regulating device; and
- means for controlling the regulating device which are connected to the sensor in order to control the flow of carrier gas injected through the regulating device at any moment in time as a function of the difference between the pressure measured by the sensor and a specified gas extraction pressure.

The device according to the invention may comprise one or more of the following features, either in isolation or in any number of technically feasible combinations:

- the sensor is located upstream of the extraction opening;
- the sensor is located in the carrier gas admission pipe;
- the sensor is located in the extraction pipe;
- the extraction pipe comprises a flow regulator, the sensor being located upstream of the flow regulator;
- the regulating device is located near to the enclosure, the admission pipe having a downstream section with a length greater then zero which is located between the enclosure and the regulating device;
- the control means comprise means for calculating the difference between the specified extraction pressure and the pressure measured by the sensor, means for comparing the calculated difference from a threshold error value and means for controlling the regulating device as a function of the result obtained by the comparison means;
- the threshold error value is less than 2 mbar;
- the admission pipe contains a flowmeter; and
- the gas extraction pipe is connected downstream to suction means.

The invention also relates to an assembly for analysing the gases contained in drilling mud, characterised that it comprises

- an extraction device as defined above;
- means for sampling drilling mud which are connected to the transport means; and
- analysis means which are connected to the extraction pipe.

The invention also relates to a process for extracting at least one gas contained in drilling mud of the type comprising the following stages:

- transfer of the drilling mud into an enclosure;
- admission of a carrier gas into the enclosure via an admission pipe, this admission including regulation of the flow of carrier gas admitted into the enclosure by a regulating device;
- extraction of gas from the enclosure via an extraction pipe opening into the enclosure via a gas extraction opening; and
- removal of drilling mud from the enclosure;
- characterised in that the admission stage comprises:
- instantaneous measurement of the pressure at a point located downstream of the regulating device; and
- control of the flow of carrier gas injected through the regulating device at any moment in time as a function of the difference between the pressure measured and a specified gas extraction pressure.

The process according to the invention may comprise one or more of the following characteristics, either in isolation or in any number of technically feasible combinations:

- control of the flow of carrier gas comprises the following phases:
  - calculation of the difference between the specified extraction pressure and the pressure measured by the sensor;
  - comparison of the calculated difference from a threshold error value; and control of the regulating device as a function of the result obtained by the said comparison; and the threshold error value is less than 2 mbar.

BRIEF DESCRIPTION OF THE DRAWINGS

An example of an embodiment of the invention will now be described with reference to the attached drawings in which.

DETAILED DESCRIPTION OF THE INVENTION

In the following text, the terms "upstream" and "downstream" refer to the normal direction in which a fluid flows in a pipe.

An analysis assembly according to the invention is, for example, used in a drilling facility for an oil-producing well.

Figure 1:
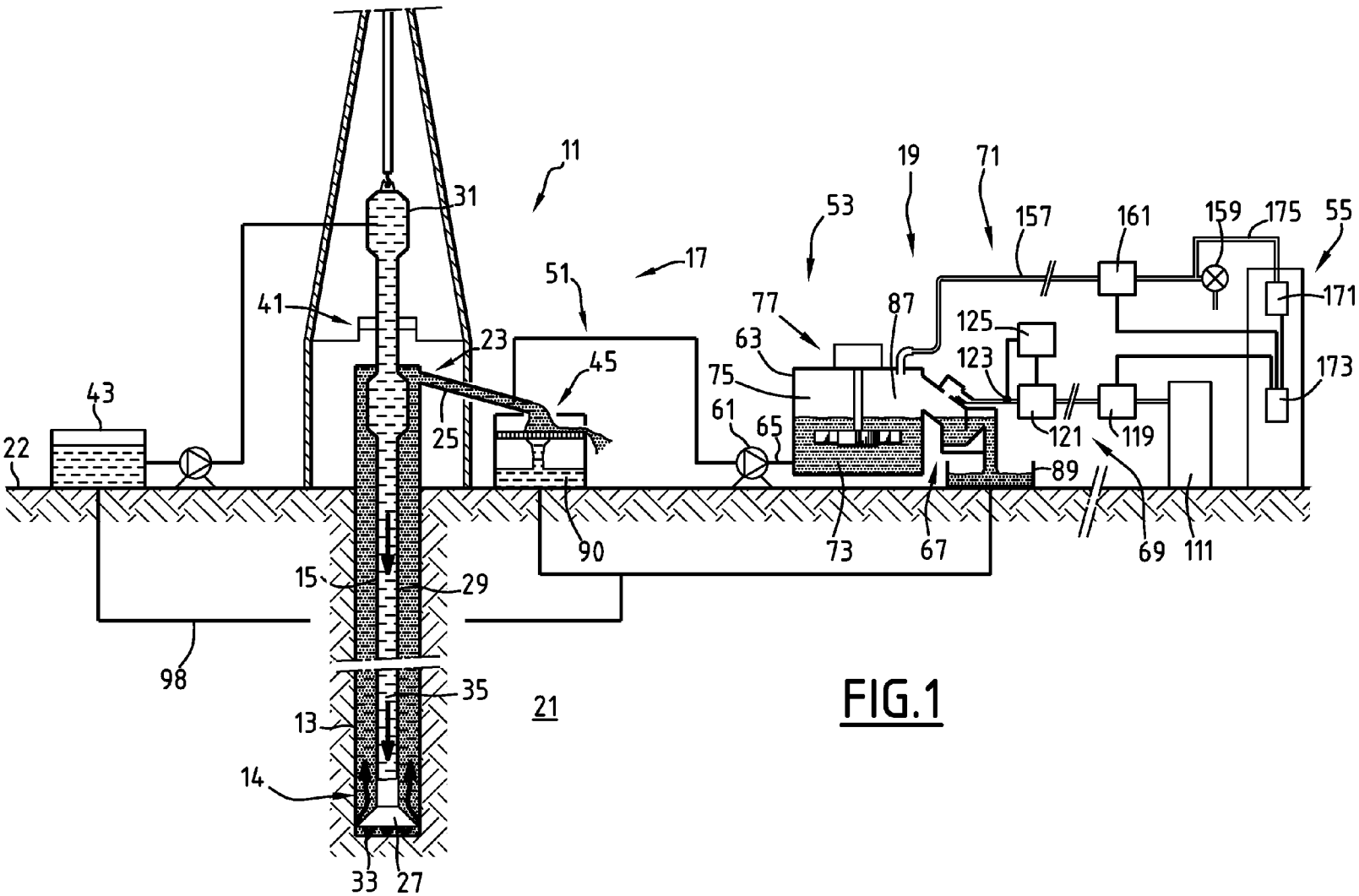
FIG. 1 is a schematic view of a vertical cross-section through a drilling facility equipped with an analysis assembly according to the invention.

As illustrated in FIG. 1, this facility 11 comprises a drilling conduit 13 located in a cavity 14 made by a rotary drilling tool 15, a surface facility 17 and an analysis assembly 19 according to the invention.

The drilling conduit 13 is located in the cavity 14 created in the sub-soil 21 by the rotary drilling tool 15. This conduit 13 comprises a wellhead 23 equipped with a drain pipe 25 at surface level 22.

The drilling tool 15 comprises a drill head 27, a drill string 29, and a liquid injection head 31.

The drill head 27 comprises means 33 for drilling through rocks in the sub-soil 21. It is mounted on the lower part of the drill string 29 and is positioned at the bottom of the drilling conduit 13.

The string 29 comprises a series of hollow drilling tubes. These tubes define an annulus 35 which enables a liquid to be conveyed from the surface 22 to the drill head 27. To this end, the liquid injection head 31 is screwed to the upper part of the string 29.

The surface facility 17 comprises means 41 for supporting and driving the drilling tool 15 in rotation, means 43 for injecting drilling liquid and a vibrating screen 45.

The injection means 43 are connected hydraulically to the injection head 31 in order to admit a liquid into the annulus 35 of the drill string 29 and to cause this liquid to circulate.

The vibrating screen 45 collects the liquid laden with drilling residues as it leaves the drain pipe 25 and separates the liquid from the solid drilling residues.

Figure 2:
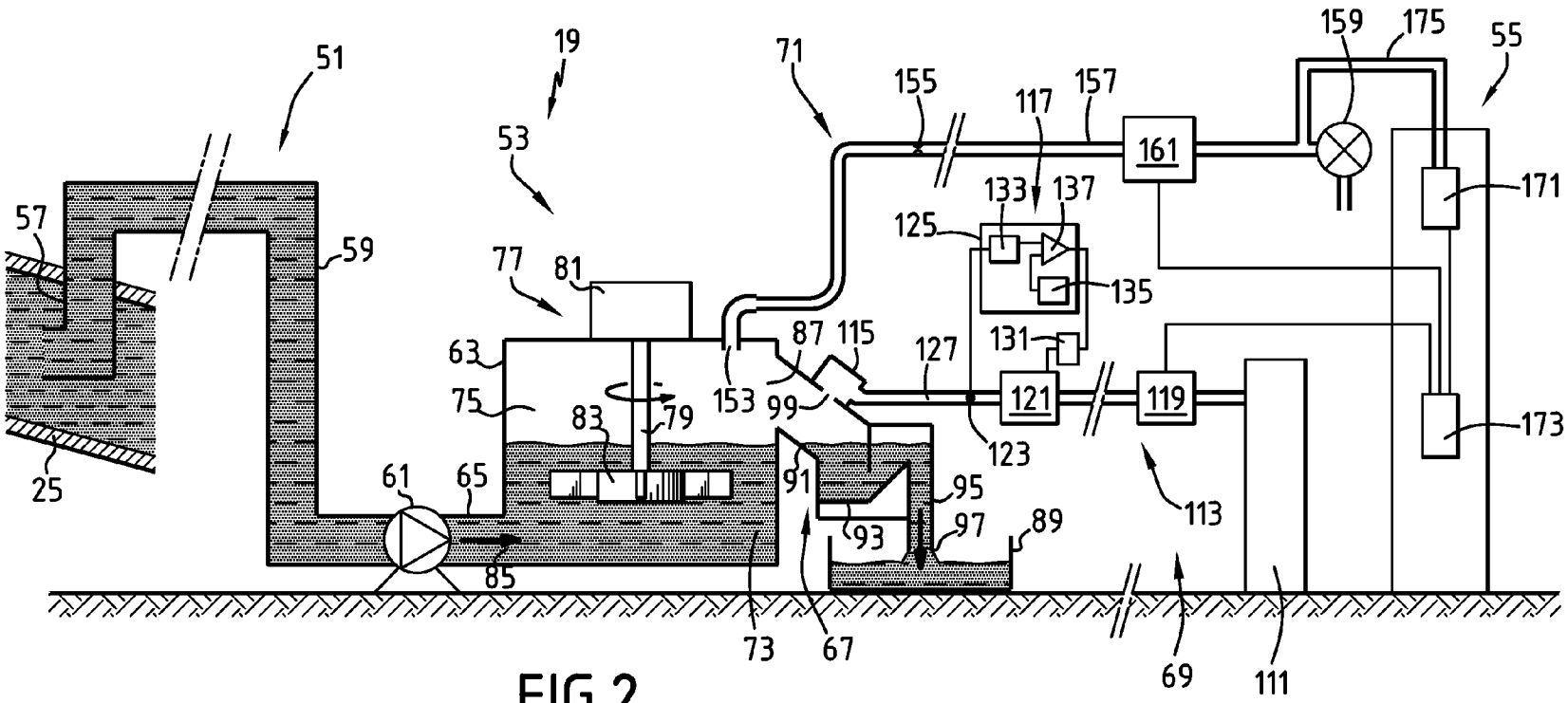
FIG. 2 is a schematic view of a vertical cross-section through the key elements of the analysis assembly according to the invention.
Figure 3:
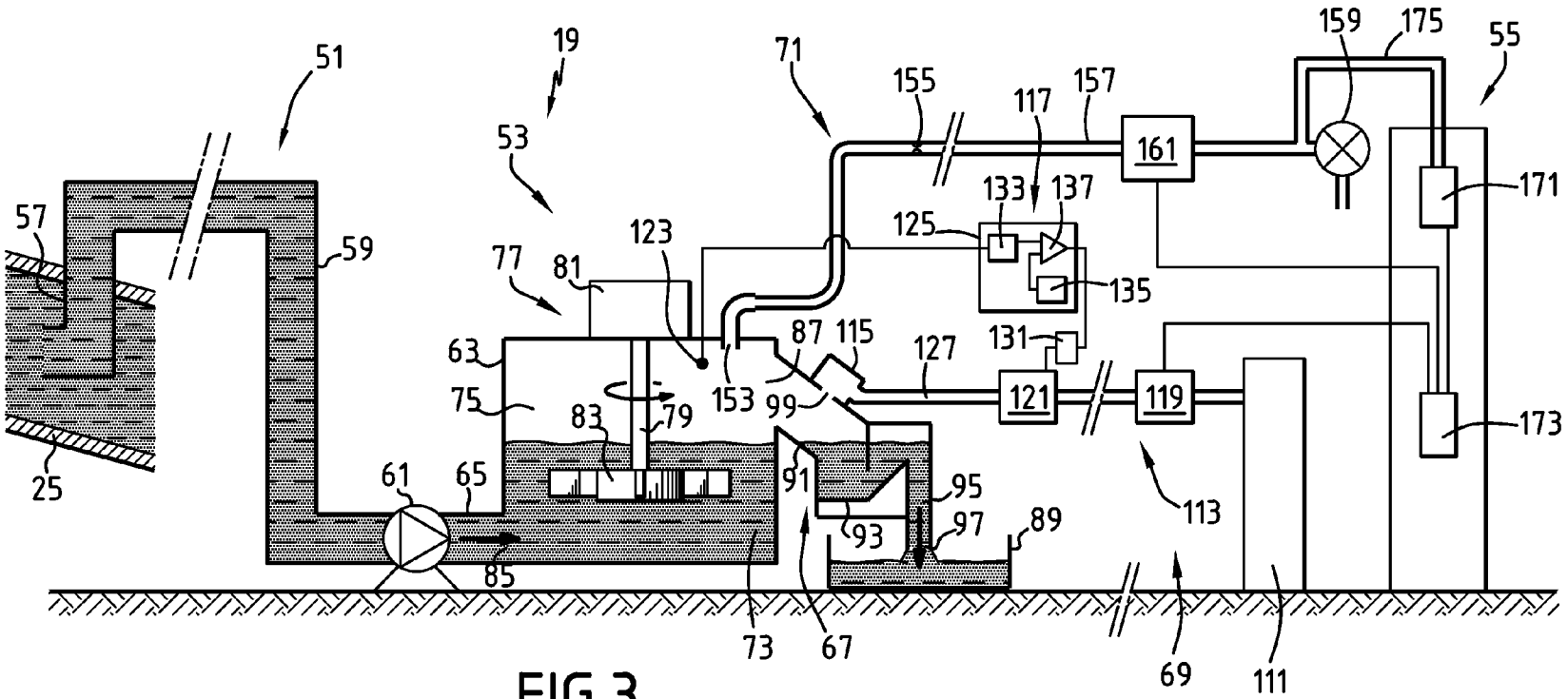
FIG. 3 is a schematic view of a vertical cross-section through the key elements of the analysis assembly according to a first alternative embodiment of the invention.
Figure 4:
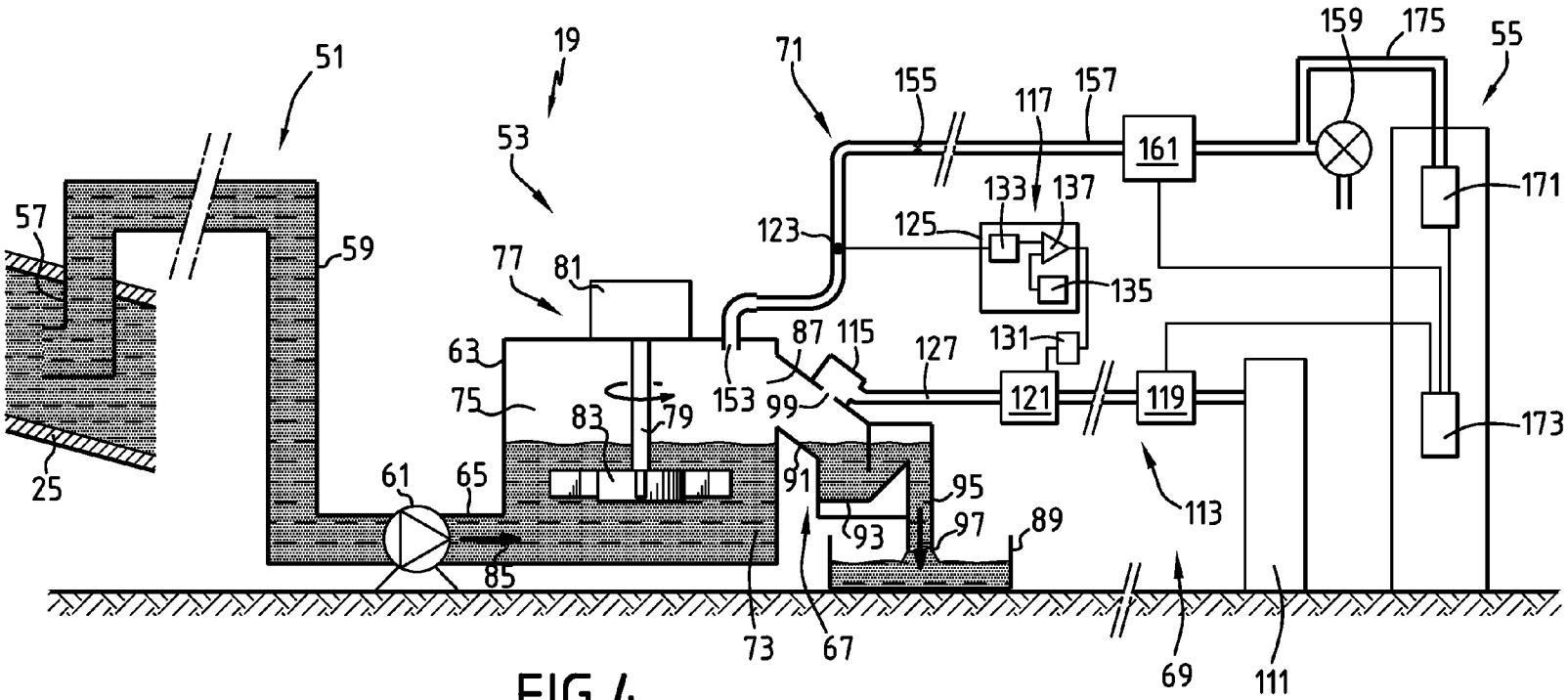
FIG. 4 is a schematic view of a vertical cross-section through the key elements of the analysis assembly according to a second alternative embodiment of the invention.

As illustrated in FIG. 2, the analysis assembly 19 comprises means 51 for sampling the mud which are attached to the drain pipe 25, a gas extraction device 53 and means 55 for analysing the extracted gases. Alternatively, the sampling means 51 are attached to a liquid collection vessel into which the drain pipe 25 leads. In another alternative, the sampling means are attached to a vessel with the means 43 for injecting mud.

The sampling means 51 comprise a liquid sampling head 57, which projects into the drain pipe 25, a connection tube 59 and a peristaltic pump 61 with an adjustable flow.

The extraction device 53 comprises an enclosure 63, a pipe 65 for conveying mud into the enclosure 63, a pipe 67 for removing mud from the enclosure 63, means 69 for admitting a carrier gas into the enclosure 63 and a pipe 71 for extracting the extracted gases from the enclosure 63.

The enclosure 63 comprises a leaktight container with an internal volume which may, for example, range between 0.4 liters and 3 liters. This enclosure 63 comprises a lower section 73 in which the mud circulates and an upper section 75 which has gaseous vapour at the top. The enclosure 63 is also equipped with agitation means 77 comprising an agitator 79, projecting into the enclosure 63 and rotated by a motor 81 fitted to the top part 75 of the enclosure 63. The agitator 79 comprises an agitation apparatus 83 immersed in the mud.

The mud transfer pipe 65 extends between the outlet from the peristaltic pump 61 and an inlet opening 85 created in the lower 73 or upper 75 part of the enclosure 63.

This transfer pipe 65 may be equipped with means for heating the mud (not illustrated) so as to increase the temperature of this mud to values ranging between 25 and 150° C., preferably between 60 and 90° C.

The evacuation pipe 67 extends between an overflow passage 87 located in the upper part 75 of the enclosure 63 and a holding tank 89 intended to collect the mud removed from the device 53.

Alternatively, the holding tank 89 is formed by a collection vessel 90 for the liquids extracted from the vibrating screen 45, illustrated in FIG. 1.

The evacuation pipe 67 comprises, in succession, an upstream section 91 which is inclined downwards, forming an angle of approximately 45° with the horizontal, an elbow section 93 forming a siphon and a downstream section 95 which is substantially vertical and open at its lower end 97 facing the tank 89 above the level of the liquid contained in the tank 89.

The mud collected in the holding tank 89 and in the vessel 90 is recycled to the injection means 43 by means of a mud recycling pipe 98.

The means 69 for admitting a carrier gas into the enclosure comprise a carrier gas source 111, a carrier gas admission pipe 113 extending between the source 111 and an inlet 115 for injecting carrier gas into the enclosure, and means 117 for controlling the admission of carrier gas into the enclosure 63.

The carrier gas source 111 contains a neutral gas with respect to the analysis process conducted in the analysis means 55. This gas, may, for example, be substantially pure nitrogen or substantially pure helium. The use of nitrogen as a carrier gas means that some non-hydrocarbon compounds contained in the mud such as hydrogen sulphide may be analysed by a gas chromatography system connected to a mass spectrometer. The use of helium means that the nitrogen contained in the drilling mud can be, analysed.

The carrier gas in the source 111 is maintained at a pressure in excess of atmospheric pressure, e.g. in excess of 1.5 bar absolute.

A mass or volume flowmeter 119 is fitted to the admission pipe 113 close to the source 111, downstream of this source.

The carrier gas injection inlet 115 emerges opposite the overflow passage 87 in the upstream part 91 of the evacuation pipe 67.

The control means 117 comprise a valve 121 with an adjustable flow cross-section fitted to the admission pipe 113, a pressure sensor 123 located in the pipe 113 downstream of the valve 121 and a regulator 125.

The valve 121 is fitted to the admission pipe close to the injection inlet 115, downstream of the flowmeter 119. A downstream section 127 of the pipe 113 connects the valve 121 to the admission inlet. The length of this downstream section 127 is greater than zero and may, for example, range between 5 cm and 200 cm.

As we shall see below; fluctuations in the pressure in the enclosure 63 at any moment in time are filtered into the downstream section 127 of the pipe 113.

The valve 121 may, for example, be a flap valve of the "on-off" type. Thus, the flap of the valve 121 can move between an open position in which the carrier gas flow cross-section in the valve 121 is at its maximum and a closed position in which this cross-section is substantially zero.

The valve 121 comprises means 131 for controlling the valve between its open position and its closed position.

The sensor 123 is fitted at a point located downstream of the valve 121. In this embodiment, the pressure sensor 123 is fitted in the downstream section 127 of the pipe 113 close to the admission inlet 115, but separate from this inlet 115.

The regulator 125 comprises means 133 for calculating the difference between a specified gas extraction pressure and the pressure measured by the sensor 123, a memory 135 containing a threshold error value for the pressure difference and means 137 for comparing the difference calculated by the calculation means 125 from the threshold error value stored in the memory 135. The comparison means 137 are connected to the means 131 for controlling the valve.

The specified gas extraction pressure may, for example, be equal to atmospheric pressure.

The threshold error value may, for example, be less than 2 mbar and preferably equal to 0.1 mbar.

Alternatively, the carrier gas injection inlet 115 emerges directly into the upper part 75 of the enclosure 63. In another alternative, the inlet 115 emerges into the lower part 73 of the enclosure 63. The carrier gas is then injected directly into the mud. In this alternative, the pressure sensor 123 is located in the upper part 75 or downstream of this part 75.

The extraction pipe 71 extends between an extraction opening 153 located in the upper part 75 of the enclosure and the analysis means 55. Viewed from upstream to downstream, it comprises a volume flow regulator 155, a transport line 157 and suction means 159.

The flow regulator 155 is formed by a tube with a neck with a calibrated cross-section.

Alternatively, the pipe 71 comprises a filtration stage (not illustrated) inserted between the extraction opening 153 and the flow regulator 155.

The transport line 157 connects the enclosure 63 located close to the wellhead 23, in the explosion zone, to analysis means 55, located away from the wellhead 23, in a non-explosion zone, e.g. in a pressurised cabin (not illustrated).

Alternatively, the analysis means 55 are located close to the enclosure 63 in the explosion zone.

This transport line 157 is preferably manufactured on the basis of a material which is inert with respect to the gaseous compounds extracted from the mud. It may, for example, be between 10 cm and 500 m long. The transport line 157 is also equipped with a volume flowmeter 161 in the illustrated embodiment.

The suction means comprise a vacuum pump 159 which conveys the gases extracted from the enclosure to the means 55 for analysis by suction.

The analysis means 55 comprise an instrumentation system 171 which allows one or more extracted gases to be detected and quantified and a calculator 173 which allows the volume and concentration of these gases extracted from the drilling mud to be determined.

The instrumentation system 171 may, for example, comprise infrared detection apparatus for quantifying carbon dioxide, FID (flame ionisation detector) chromatographs for detecting hydrocarbons or TCD (thermal conductivity detector) chromatographs, depending on the gases to be analysed. It also comprises a gas chromatography system linked to a mass spectrometer, this system being referred to by its English abbreviation "GC-MS". It is thus possible to detect and quantify a number of gases simultaneously.

The instrumentation system 171 is connected to a sampling hole or a branch 175 from the line 157 located downstream or upstream of the vacuum pump 159, close to this pump 159.

The calculator 173 is connected to the instrumentation system 171 and to the respective flowmeters 161 and 119 in the extraction pipe 157 and the admission pipe 113.

We shall now describe operation of the analysis assembly 19 according to the invention when drilling a well by way of example, with reference to FIG. 1.

In order to carry out drilling, the drilling tool 15 is driven in rotation by the surface facility 41. A drilling liquid is admitted to the annulus 35 of the drill string 29 by injection means 43. This liquid flows down to the drill head 27 and passes into the drill conduit 13 through the drill head 27. This liquid cools and lubricates the drilling means 33. The liquid then collects the solid debris arising from drilling and passes back up through the annulus defined between the drill string 29 and the walls of the drilling conduit 13 and is then removed via the drain pipe 25. The liquid containing the debris thus forms the drilling mud to be analysed.

With reference to FIG. 2, the peristaltic pump 61 is then activated, in order to sample, on a continuous basis, a specified fraction of the drilling mud flowing into the pipe 25.

This mud fraction is conveyed to the enclosure 63 via the transfer pipe 65 and admitted into the enclosure.

The mud admitted into the enclosure 63 via the transfer pipe 65 is removed by overflowing into the evacuation pipe 67 via the overflow passage 87. In addition, some of the removed mud remains temporarily in the siphon 93 of the evacuation pipe 67 which prevents gas entering the upper part 75 of the enclosure 63 via the lower end 97 of the evacuation pipe 67. Gas is therefore admitted into the enclosure 63 solely by the means for admitting the carrier gas 69.

The agitator 79 is rotated by the motor 81 and agitates the mud in the lower part 73 of the enclosure 63 in order to extract the gases contained in the mud and the mixture of gases extracted with the carrier gas admitted via the injection passage 99.

At any moment in time, the sensor 123 measures the pressure in the admission pipe 113, downstream of the valve 121. This pressure is substantially equal to the pressure in the enclosure 63.

The calculation means 133 determine the difference between a specified pressure, e.g. atmospheric pressure, and the pressure measured at a given moment in time.

The comparison means 137 compare this difference with the threshold error value stored in the memory 135 at any moment in time. If this difference is greater than the threshold error value stored in the memory 135, the comparison means 137 activate the means 131 for controlling the valve to move this valve from its closed position to its open position.

As the pressure in the gas source 111 is greater than the selected gas extraction pressure, a flow of carrier gas is then admitted into the enclosure 63 via the valve 121 and the admission inlet 115. The carrier gas admitted into the enclosure 63 reduces the pressure difference between the specified pressure and the pressure in the enclosure 63.

If the comparison means 137 establish that the pressure difference is lower than the threshold error value, they activate the means 131 for controlling the valve to move this valve from its open position to its closed position.

The gaseous mixture extracted from the enclosure 63 is conveyed via the extraction pipe 71 under the effect of suction generated by the vacuum pump 159. This mixture is transported to the analysis means 55, where it is qualified and quantified by the instrumentation system 171 and the calculator 173.

During this quantification process, the flow $Q_{gas\ extracted}$ of gas extracted from the mud is calculated at a given moment in time by using the following formula:

$$Q_{gas\ extracted}=Q_{m\ extraction\ pipe}-Q_{m\ admission\ pipe} \quad (1)$$

where $Q_{m\ extraction\ pipe}$ is the flow of gas measured by the flowmeter 161 through the extraction pipe 71 and $Q_{m\ admission\ pipe}$ is the flow of gas measured by the flowmeter 119 through the admission pipe 113.

The volume and content of a specified gas extracted from the mud at a given moment in time is calculated on the basis of the value measured by the instrumentation system 171 at a later moment in time which depends on the time taken for the extracted gas to pass through the extraction pipe 71, on the basis of the flow $Q_{gas\ extracted}$ of gas extracted from the mud into the enclosure 63 at a given moment in time calculated using the formula (I) above, and on the basis of the flow $Q_{m\ admission\ pipe}$ of gas injected into the enclosure 63, as measured by the flowmeter 119 at a later moment in time which depends on the time taken for a valve 121 response to be picked up by the flowmeter 119 at the other end of the admission pipe 113.

As the flow $Q_{gas\ extracted}$ of gas extracted from the mud into the enclosure 63 is known at any given moment in time, the analysis assembly 19 according to the invention thus enables some of the compounds extracted from the mud to be analysed quantitatively without the need to conduct a quantitative analysis of all the compounds extracted from the mud at each moment in time.

In an alternative, the extraction pipe 71 does not have a flowmeter 161. In this alternative, the gas flow circulating in the pipe 71 is maintained constant by the flow regulator 155. The value of this flow is determined or confirmed by calibration by making water flow into the enclosure 63 and by measuring the flow of carrier gas injected into the enclosure 63 with the aid of the flowmeter 119 in the admission pipe 113.

In another alternative, the analysis assembly 19 is calibrated before connection to the facility 11. The source of carrier gas is replaced by a standard mixture of gas to be analysed which is injected into the enclosure 63 containing circulating water or another fluid which does not contain any gases to be extracted and which are neutral with respect to the standard mixture. The analysis parameters such as the specified gas extraction pressure and the gas flow circulating through the regulator 155 are selected so as to be substantially identical to the parameters used during the subsequent mud analysis.

Alternatively, the sensor 123 is fitted upstream of the extraction opening 153, e.g. in the upper part 75 of the enclosure 63.

In another alternative, the sensor 123 is fitted in the extraction pipe 71, close to the extraction opening 153, preferably upstream of the flow regulator 155. The sensor 123 is fitted at a point in this pipe 71 such that the difference between the pressure at this point and the pressure in the enclosure 63 at a given moment in time is less than 200 mbar.

In another alternative, the valve 121 is a proportional type of valve and comprises a gas flow orifice with an adjustable cross-section. The process according to the invention comprises a stage for controlling the gas flow cross-section in the valve 121 at any moment in time as a function of the difference between the specified extraction pressure and the pressure measured by the sensor 123.

In the device 53 according to the invention, the pressure in the enclosure 63 is regulated to substantially the specified pressure to within the threshold error value. As a result, irrespective of variations in the gaseous content of the drilling mud, the pressure in the enclosure 63 remains substantially constant and the gas extraction conditions into this enclosure 63 are substantially independent of the gaseous content of the mud. Quantification of the gases contained in the drilling mud is thus very accurate.

Furthermore, since the carrier gas used is not taken from the atmosphere prevailing around the well, any pollution by hydrocarbon compounds in this atmosphere is avoided.

In addition, when the gaseous content of the mud is low or virtually zero, the gas flow sucked through the extraction pipe 151 as a result of the pump 159 is substantially offset by the gas flow admitted through the admission pipe 113, which prevents the extraction pipe 171 becoming blocked.

The transit time through the extraction pipe 71 is maintained substantially constant irrespective of the quantity of gas extracted from the mud at any moment in time.

Extraction conditions in the device according to the invention are therefore regulated automatically, thus increasing reliability.

Thus, in the event of a partial blockage of the flow regulator 155 during analysis, the pressure in the enclosure 63 remains substantially identical and gas extraction into the enclosure 63 continues in substantially the same conditions.

If the pressure sensor 123 is located outside the enclosure 63 in the admission pipe 113, it is easier to regulate the pressure in the enclosure 63, since pressure fluctuations in the enclosure 63 at a given moment in time are filtered in the downstream section 127 of the pipe 113.

If a flowmeter 119 is fitted in the admission pipe 113, the analysis assembly 19 can calculate the content of a given gas extracted from the mud at any moment in time without calculating the content of all the gases extracted from the mud on a quantitative basis.

The invention claimed is:

1. A device for extracting at least one gas contained in drilling mud, comprising:

an enclosure;

means for conveying the drilling mud into the enclosure;

means for removing the drilling mud from the enclosure;

means for admitting a carrier gas into the enclosure comprising a carrier gas admission pipe which connects a source of carrier gas to the enclosure, the admission pipe being equipped with a regulating device for regulating the flow of carrier gas circulating in the pipe; and a gas extraction pipe opening into the enclosure via a gas extraction opening;

wherein the means for admitting the carrier gas further comprise:

a sensor for measuring an instantaneous pressure which is substantially identical to the pressure inside the enclosure, the sensor being arranged at a point located downstream of the regulating device; and means for controlling the regulating device which are connected to the sensor in order to control the flow of carrier gas injected into the enclosure via the regulating device at any moment in time as a function of the difference between the pressure measured by the sensor and a specified gas extraction pressure.

2. The device according to claim 1, wherein the sensor is located upstream of the extraction opening.

3. The device according to claim 1, wherein the sensor is located in the carrier gas admission pipe.

4. The device according to claim 1, wherein the sensor is located in the extraction pipe.

5. The device according to claim 4, wherein the extraction pipe comprises a flow regulator, the sensor being located upstream of the flow regulator.

6. The device according to claim 1, wherein the regulating device is located close to the enclosure, and wherein the admission pipe comprises a downstream section of a length which is greater than zero located between the enclosure and the regulating device.

7. The device according to claim 1, wherein the control means comprise:

means for calculating the difference between the specified extraction pressure and the pressure measured by the sensor;

means for comparing the calculated difference with a threshold error value; and means for controlling the regulating device as a function of the result obtained by the comparing means.

8. The according to claim 7, wherein the threshold error value is less than 2 mbar.

9. The device according to claim 1, wherein the admission pipe comprises a flowmeter.

10. The device according to claim 1, wherein the gas extraction pipe is connected downstream to suction means.

11. Assembly for analysing gases contained in drilling mud, comprising:

the extraction device according to claim 1;

means for sampling drilling mud which are connected to the transfer means; and analysis means connected to the extraction pipe.

12. A method for extracting at least one gas contained in drilling mud, said method comprising:

conveying the drilling mud into an enclosure;

admitting a carrier gas into the enclosure via an admission pipe, said admitting of the carrier gas including regulating the flow of carrier gas admitted into the enclosure by a regulating device;

extracting gas from the enclosure via an extraction pipe opening in the enclosure via a gas extraction opening; and removing the drilling mud from the enclosure, wherein said admitting of the carrier gas further comprises:

instantaneously measuring a pressure substantially equal to the pressure prevailing in the enclosure, with a sensor at a point located downstream of the regulating device; and at any moment in time, controlling the flow of carrier gas injected into the enclosure through the regulating device as a function of the difference between the pressure measured and a specified gas extraction pressure.

13. The method according to claim 12, wherein said controlling of the carrier gas flow comprises:

calculating the difference between the specified extraction pressure and the pressure measured by the sensor;

comparing the calculated difference with a threshold error value; and controlling the regulating device as a function of the result obtained by said comparing of the calculated difference with the threshold error value.

14. The method according to claim 13, wherein the threshold error value is less than 2 mbar.

* * * * *